US007845388B2

(12) United States Patent
Luo et al.

(10) Patent No.: US 7,845,388 B2
(45) Date of Patent: Dec. 7, 2010

(54) GALVANIC CORROSION PROTECTION FOR MAGNESIUM COMPONENTS USING CAST-IN-PLACE ISOLATORS

(75) Inventors: Aihua A. Luo, Troy, MI (US); Mark W. Verbrugge, Troy, MI (US); Anil K. Sachdev, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 603 days.

(21) Appl. No.: 11/536,028

(22) Filed: Sep. 28, 2006

(65) Prior Publication Data

US 2008/0078521 A1 Apr. 3, 2008

(51) Int. Cl.

| | |
|---|---|
| ***B22D 19/04*** | (2006.01) |
| ***B22D 19/16*** | (2006.01) |
| ***B32B 3/06*** | (2006.01) |
| ***B32B 15/01*** | (2006.01) |

(52) U.S. Cl. ..... 164/98; 164/111; 428/649; 428/609; 428/614

(58) Field of Classification Search ..... 164/98, 164/100, 111; 428/649, 582, 609, 614
See application file for complete search history.

(56) References Cited

U.S. PATENT DOCUMENTS

| | | | | |
|---|---|---|---|---|
| 2,011,613 | A * | 8/1935 | Brown et al. | 204/196.18 |
| 2,100,257 | A * | 11/1937 | Larson | 428/649 |
| 4,290,868 | A | 9/1981 | Mack | |
| 4,960,296 | A | 10/1990 | Thelen et al. | |
| 5,333,913 | A | 8/1994 | Stallard | |
| 6,659,702 | B2 | 12/2003 | Kitayama et al. | |
| 6,673,469 | B2 * | 1/2004 | Isaccsson et al. | 428/642 |
| 6,880,940 | B1 | 4/2005 | Binfet | |
| 2006/0177683 | A1 * | 8/2006 | Ballyns et al. | 428/582 |

FOREIGN PATENT DOCUMENTS

JP 2001-246456 A * 9/2001

* cited by examiner

*Primary Examiner*—Kevin P Kerns
(74) *Attorney, Agent, or Firm*—Reising Ethington P.C.

(57) ABSTRACT

Magnesium or magnesium alloy components having galvanic corrosion protection isolators secured in place by metallurgical bonding during casting of the magnesium or magnesium alloy component. The isolators are formed of materials that are characterized by an absolute potential difference that is between that of magnesium and a contacting metallic component.

9 Claims, 2 Drawing Sheets

GALVANIC CORROSION PROTECTION FOR MAGNESIUM COMPONENTS USING CAST-IN-PLACE ISOLATORS

TECHNICAL FIELD

The present invention relates generally to the field of corrosion prevention. More particularly, the invention relates to a system for isolation of magnesium components to prevent galvanic corrosion.

BACKGROUND OF THE INVENTION

Automotive frames and other metallic structures may make use of combinations of materials in order to obtain desirable characteristics of strength while simultaneously reducing weight. In this regard, it is known to utilize magnesium components in automotive vehicles and other structures where minimization of weight may be desirable. As will be appreciated, magnesium provides an excellent strength to weight ratio relative to materials such as structural steel.

In order to promote structural stability, magnesium components are often used in combination with components of steel or other metals. However, it has been found that if magnesium components are held in contacting relation to steel or other structural materials, the magnesium may tend to suffer from galvanic corrosion. Such corrosion arises due to the relative potential differences between the metals. As will be understood by those of skill in the art, the standard potential of a given metal is typically defined relative to that of a hydrogen electrode which is arbitrarily defined as zero. The potentials between metals are then determined by taking the absolute differences between their standard potential levels. A greater potential difference between metals promotes greater galvanic corrosion.

As will be appreciated, there is a substantial potential difference between iron and magnesium such that galvanic corrosion is actively promoted in regions of contact between those metals. It is known that the corrosion potential may be reduced by placing an isolating buffer metal with an intermediate potential between the magnesium and other metal components. In the past, buffer metals that have been utilized have been in the form of aluminum plates and inserts that provide spacing between the magnesium and the steel or other structural metal components. Plates have typically been attached using adhesive bonding techniques while inserts have been applied using press-in techniques. While these past protection systems have been functional, the adhesive-applied and press-in structures may be prone to becoming disengaged. Moreover, the application processes themselves may be laborious and time consuming.

SUMMARY OF THE INVENTION

This invention is believed to provide advantages and/or alternatives over prior practices by incorporating isolators of buffer material that are secured in place within the magnesium component by metallurgical bonding during casting of the magnesium component. These cast-in-place isolators are formed of materials that are characterized by an absolute potential difference that is between that of magnesium and iron based metals. Moreover, the material forming the isolators may be metallurgically bonded within the magnesium.

BRIEF DESCRIPTION OF THE DRAWINGS

The accompanying drawings which are incorporated in and which constitute a portion of this specification illustrate various exemplary embodiments of the invention which, together with the general description above and the detailed description set forth below will serve to explain the principals of the invention wherein.

Figure 1:
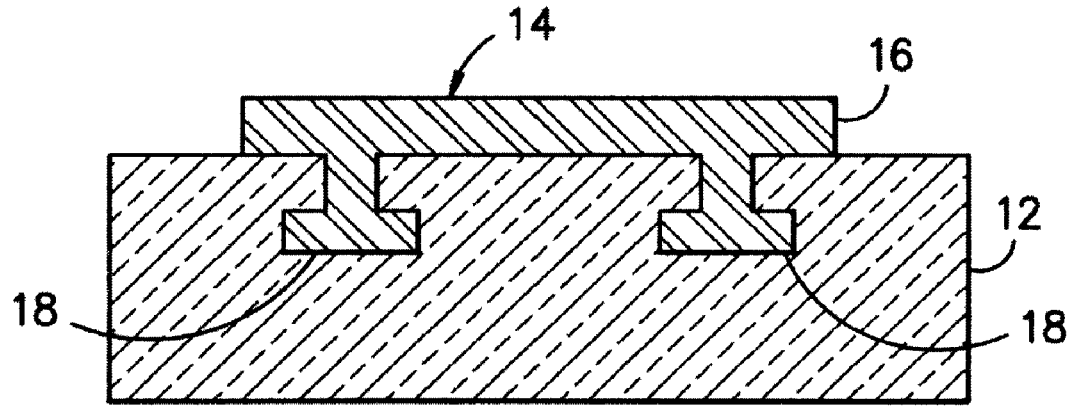
FIG. 1 is a cut-away schematic view of a magnesium or magnesium alloy part with a cast-in-place isolator plate secured in place across a surface.

While exemplary embodiments have been illustrated and generally described above, and will hereinafter be described in connection with certain potential preferred procedures and practices, it is to be understood and appreciated that in no event is the invention to be limited to such embodiments, procedures, or practices as may be illustrated and described herein. On the contrary, it is intended that the invention shall extend to all alternatives and modifications as may embrace the broad principals of the invention within the true spirit and scope thereof.

DETAILED DESCRIPTION OF PREFERRED EMBODIMENTS

Reference will now be made to the various drawings wherein to the extent possible, like elements are designated by corresponding reference numerals in the various views.

FIG. 1 is a schematic view illustrating a magnesium or magnesium alloy component 12 with an isolator plate structure 14 secured in metallurgical metal to metal bonded relation across the magnesium or magnesium alloy component 12. As shown, the isolator place structure 14 includes a face plate portion 16 and an arrangement of leg elements 18 extending in locking relation into the magnesium or magnesium alloy component 12 with surface to surface bonding between the leg elements and the magnesium or magnesium alloy component 12.

According to a contemplated and potentially preferred practice, the corrosion isolator structure 14 may be secured in place to the magnesium or magnesium alloy component 12 during the casting of the alloy component 12. According to this practice, the preformed corrosion isolator structure 14 is placed in the mold and the magnesium or magnesium alloy component 12 is the cast around the leg portions 18. Such a casting operation provides a substantially continuous metallurgical bonding between the corrosion isolator structure 14 and the magnesium or magnesium alloy component 12 without the use of intermediate adhesives. In this regard it is to be understood that the term "metallurgical bonding" refers to bonds formed by the solidification of the magnesium or magnesium alloy component 12 in contacting relation with a surface of the isolator structure 14 such that there is at least a partial atomic migration at the interface between the magnesium or magnesium alloy component 12 and the isolator structure 14.

As previously indicated, the corrosion isolator structure 14 is preferably formed from a material which is less anodic than the magnesium or magnesium alloy component 12. At the same time, it is desirable to avoid a substantial potential difference between the material forming the corrosion isolator structure 14 and the magnesium or magnesium alloy component 12. Moreover, it is desirable that the corrosion isolator structure 14 form a strong metallurgical bond with a magnesium or magnesium alloyed component 12. It has been found that a corrosion isolator 14 formed from aluminum or an aluminum-based alloy may satisfy these requirements. Of course, it is also contemplated that other materials that provide galvanic isolation while bonding to the magnesium or magnesium alloy component 12 may likewise be utilized if desired. In particular, it is contemplated that steel coated with an aluminum alloy or other buffer metal may likewise be utilized. It is also contemplated that the corrosion isolator structures 14 may be in the form of ceramic coated metal or other materials that provide corrosion isolation.

As will be appreciated, the use of corrosion isolator structures that are held in place by metallurgical bonding during the part casting operation provides a number of benefits. Specifically, the cast-in-place isolators are fixed in place thereby substantially avoiding the possibility of displacement during shipment and/or assembly operations. Moreover, a substantially uniform and coherent interfacial bonding is established between the corrosion isolator structure and the magnesium or magnesium alloy component. This is believed to reduce the possibility of moisture migration. Finally, by casting the corrosion isolator structure in place, substantial dimensional control can be maintained.

Figure 2:
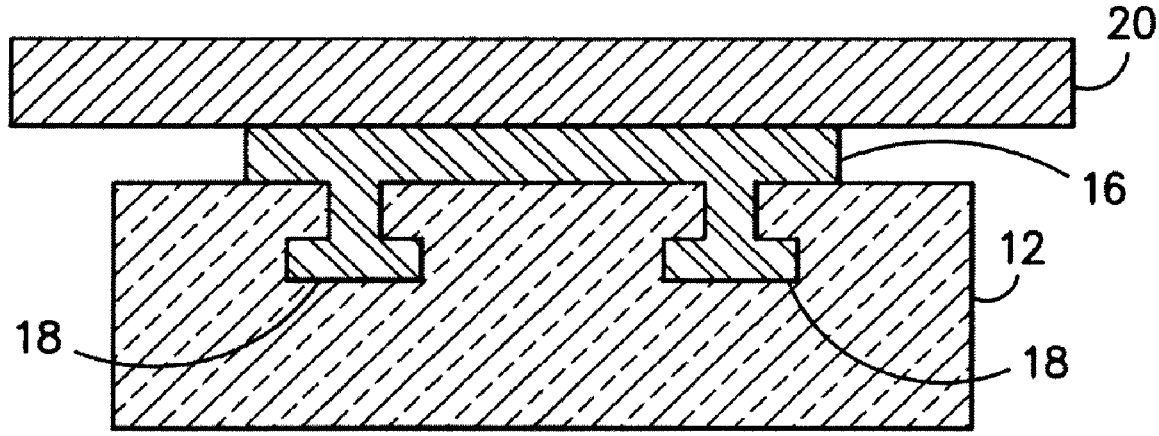
FIG. 2 illustrates the magnesium or magnesium alloy part with isolator plate as shown in FIG. 1 in contacting relation with a structure of a different metal.

Regardless of the configuration or materials used in the corrosion isolator structure, such a structure should provide substantial isolation between the magnesium or magnesium alloy component 12 and other structures formed from materials having substantially greater relative potential levels. FIG. 2 provides a simplified illustration of the isolating function provided by the corrosion isolator structure. As shown in this illustrated practice, a cast-in-place corrosion isolator structure as previously described is positioned such that the face plate portion 16 provides an isolation barrier between the magnesium or magnesium alloy component 12 and an overlying structure 20 which may be fabricated of steel, or other material characterized by a substantial galvanic potential difference relative to the magnesium or magnesium alloy component 12. While iron based materials such as steel are likely to be those most commonly isolated from the magnesium or magnesium alloy component 12, the contemplated system is also useful in isolating virtually any other material that is cathodic relative to the magnesium or magnesium alloy component 12.

Figure 3:
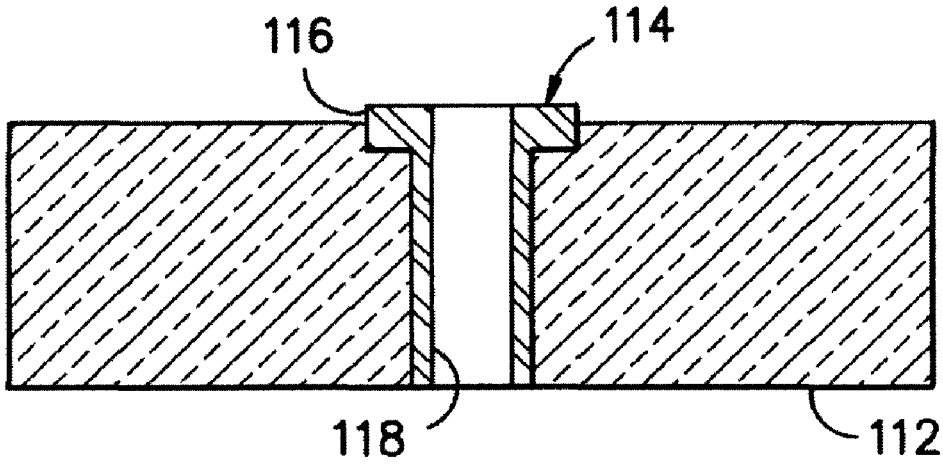
FIG. 3 illustrates a magnesium or magnesium alloy part with a cast-in-place through hole insert of a buffer metal.

While the arrangement illustrated in FIG. 2 shows a barrier between juxtaposed structures, it is likewise contemplated that the instant invention is likewise applicable to providing corrosion isolation between a magnesium or magnesium alloy component 12 and structures that may be inserted partially or completely through such components. By way of example only, FIG. 3 is a simplified cross-section illustrating a magnesium or magnesium alloy component 112 having a corrosion isolator structure 114 in the form of a sleeve extending at least partially through the magnesium or magnesium alloy component 112. According to a potentially preferred practice, the corrosion isolator structure 114 is preformed and placed in the mold during casting of the magnesium or magnesium alloy component 112. As previously described, this provides a substantially contiguous metallurgical bond between the magnesium or magnesium alloy component 112 and the sleeve forming the corrosion isolator structure 114.

As illustrated, the sleeve forming the corrosion isolator structure 114 preferably includes an enhanced diameter head portion 116 that projects slightly above the surface of the magnesium or magnesium alloy component 112. The sleeve forming the corrosion isolator structure 114 also preferably includes a projecting body portion 118 that forms a continuous barrier between the interior of the sleeve and the magnesium or magnesium alloy component 112.

Figure 4:
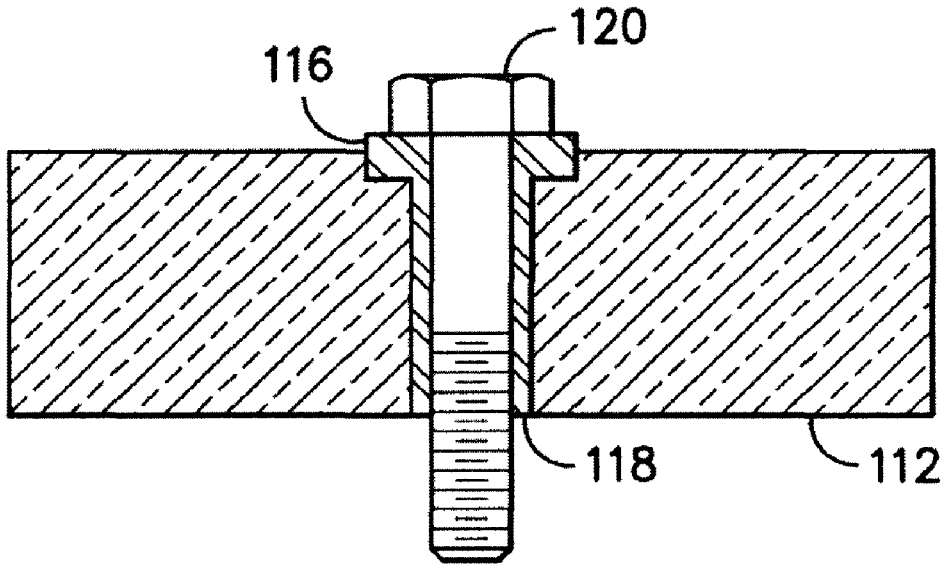
FIG. 4 is a view similar to FIG. 3 illustrating a connector in the form of a bolt extending through the insert.

As illustrated in FIG. 4, the sleeve forming the corrosion isolator structure may be used to provide substantial galvanic isolation between the magnesium or magnesium alloy component 112 and an inserted component 120 such as a steel bolt or other fastening element that is inserted through the magnesium or magnesium alloy component 112. As shown, both the body and the head of the bolt are substantially isolated from any contact with the magnesium or magnesium alloy component 112 thereby substantially avoiding galvanic corrosion. Of course, it is to be understood that the materials forming the corrosion isolator structure 114 may be any of those previously described in relation to the surface plate structure.

It is to be understood that while the present invention has been illustrated and described in relation to potentially preferred embodiments, constructions, and procedures, that such embodiments, constructions, and procedures are illustrative and exemplary only and that the present invention is in no event limited thereto. In this regard, the invention is in no way to be construed as being limited to the exemplary plate and sleeve structures which have been illustrated. Rather, it is contemplated that the invention shall extend to all modification and variations embodying the principals of the invention wherein cast-in-place isolators are utilized.

What is claimed:

1. A method of providing galvanic corrosion protection to a magnesium or magnesium alloy component for making a multi-component automotive structural member, the method comprising the steps of: (a) providing at least one preformed aluminum or aluminum alloy galvanic corrosion isolator with a first surface comprising at least one integral leg and foot portion shaped for locking relationship with the magnesium or magnesium alloy component for the structural member, and at least a second surface defining a contact surface for an iron based contacting structure for the structural member, and wherein the galvanic corrosion isolator is cathodic relative to the magnesium or magnesium alloy component; and (b) casting the magnesium or magnesium alloy component in place in mechanical locking relation around each integral leg and foot portion of the galvanic corrosion isolator and in metallurgical bonded relation with the first surface.

2. The method as recited in claim 1, wherein the second surface comprises a surface plate portion.

3. The method as recited in claim 2, wherein a plurality of leg and foot portions extend away from the surface plate portion into the magnesium or magnesium alloy component.

4. A method of providing galvanic corrosion protection to a magnesium or magnesium alloy component for making a multi-component automotive structural member, the method comprising the steps of: (a) providing at least one preformed galvanic corrosion isolator consisting essentially of aluminum alloy with a first surface comprising at least one integral leg and terminal foot portion shaped for locking relationship with a magnesium or magnesium alloy component, and at least a second surface defining a contact surface for a steel contacting structure and wherein the galvanic corrosion isolator is cathodic relative to the magnesium or magnesium alloy component; and (b) casting the magnesium or magnesium alloy component in place in mechanical locking relation around each integral leg and terminal foot portion of the galvanic corrosion isolator and in metallurgical bonded relation with the first surface of the galvanic corrosion isolator.

5. The method as recited in claim 4, wherein the second surface comprises a surface plate portion.

6. The method as recited in claim 5, wherein a plurality of leg and terminal foot portions extend away from the surface plate portion into the magnesium or magnesium alloy component.

7. A multi-component automotive structural member having a magnesium or magnesium alloy component formed by the method of claim 1 such that the at least one integral leg and foot portion of the aluminum or aluminum alloy galvanic corrosion isolator is secured in metallurgical bonded relation within the magnesium or magnesium alloy component, and wherein the galvanic corrosion isolator is cathodic relative to the magnesium or magnesium alloy component.

8. A multi-component automotive structural member having a magnesium or magnesium alloy component formed by the method of claim 4 such that the at least one integral leg and foot portion of the aluminum alloy galvanic corrosion isolator is secured in metallurgical bonded relation within the magnesium or magnesium alloy component, and wherein the galvanic corrosion isolator is cathodic relative to the magnesium or magnesium alloy component.

9. A method of providing galvanic corrosion protection to a magnesium or magnesium alloy component for making a multi-component automotive vehicle structural member, the method comprising the steps of:

(a) providing at least one preformed aluminum or aluminum alloy galvanic corrosion isolator comprising at least a first surface further comprising at least one integral leg and terminal foot portion and at least a second surface defining a contact surface for a contacting iron based structure and wherein the galvanic corrosion isolator is cathodic relative to the magnesium or magnesium alloy component;

(b) casting the magnesium or magnesium alloy component in place in mechanical locking relation around each integral leg and terminal foot portion of the galvanic corrosion isolator with the magnesium metallurgically bonded to the first surface;

(c) contacting the contact surface with the contacting iron based structure.

* * * * *